US005366109A

United States Patent [19]

Proshan

[11] Patent Number: 5,366,109

[45] Date of Patent: Nov. 22, 1994

[54] REMOVABLE CAP FOR DISPOSABLE CONTAINERS OF LIQUID

[76] Inventor: Mary-Elizabeth Proshan, Suite 194. 301 N. Harrison St., Princeton, N.J. 08540

[21] Appl. No.: 224,159

[22] Filed: Apr. 7, 1994

[51] Int. Cl.[5] ..... A47G 19/22

[52] U.S. Cl. ..... 220/717; 220/713; 220/306; 220/380

[58] Field of Search ..... 220/705, 713, 717, 718, 220/380, 306; 222/566, 570, 571, 574

[56] References Cited

U.S. PATENT DOCUMENTS

| | | | |
|---|---|---|---|
| 4,756,440 | 7/1988 | Gartner | 220/254 X |
| 4,782,975 | 11/1988 | Coy | 220/717 |
| 4,811,860 | 3/1989 | Sorensen et al. | 220/380 |
| 4,828,141 | 5/1989 | Coy | 220/380 |
| 4,899,902 | 2/1990 | DeMars | 220/254 |
| 4,953,737 | 9/1990 | Meyers | 220/717 X |
| 4,961,510 | 10/1990 | Dvoracek | 220/717 |
| 5,253,781 | 10/1993 | Van Melle et al. | 220/713 |

FOREIGN PATENT DOCUMENTS

| | | | |
|---|---|---|---|
| 2205309 | 12/1988 | United Kingdom | 220/713 |

*Primary Examiner*—Gary E. Elkins
*Assistant Examiner*—Stephen Cronin

[57] ABSTRACT

A cap for detachably enclosing an upper open end of a hollow vertical disposable container with liquid therein employs a flat horizontal disc having first and second openings disposed in spaced apart positions therein. The first opening is a pin hole. The second opening is relatively large. The disc has a peripheral socket adapted to engage the periphery of the upper end of the container in such manner that liquid cannot flow out therebetween. A hollow vertical hollow spout tapers upwardly and outwardly from the disc and has an open lower end coincident with the second opening. The spout has an upper open end defining a first slot therein, the upper end being smaller in area than the lower end. A hollow member is disposed within the spout with an upper open end coincident with the upper end of the spout, the member extending downwardly and inwardly from the upper end of the spout to a lower end horizontally aligned with the lower end of the spout. The lower end of the member has a second slot smaller in area than that of the first slot.

5 Claims, 2 Drawing Sheets

REMOVABLE CAP FOR DISPOSABLE CONTAINERS OF LIQUID

CROSS REFERENCE TO COPENDING APPLICATION

The present application is related to copending application entitled DETACHABLE CAP FOR DISPOSABLE CONTAINERS OF LIQUID filed on even date Apr. 7, 1994 herewith, Ser. No. 08/224,158. Both applications identify the same inventor and are owned in common.

BACKGROUND OF THE INVENTION

Disposable containers containing cold or hot liquids are in wide use. In order to prevent the liquid from being accidently spilled during use, it is known to cover the open upper end of the container with a disposable cap having an upwardly extending drinking spout. The cap has a peripheral socket which engages the periphery of the upper end of the container.

Known caps when secured to such containers are subject to substantial and undesired leakage when a container of liquid covered with a known cap is disposed horizontally on its side or even when the container is disposed vertically and is subjected to sudden movement as for example when held in a moving vehicle so that the liquid surges upward and out to the spout.

The present invention is directed toward a new type of disposable cap which eliminates such liquid leakage problems.

SUMMARY OF THE INVENTION

Accordingly, it is an object of the present invention to provide a new and improved disposable cap for disposable containers of liquid wherein when said cap is secured to the open end of the container will not exhibit any appreciable leakage when the container is disposed horizontally on its side or when the container is disposed vertically and is subjected to sudden movement.

Another object is to provide a new and improved disposable cap of the character indicated which can be easily and inexpensively injection molded.

These and other objects and advantages of the invention will either be explained or will become apparent hereinafter.

In accordance with the principles of this invention, a cap for detachably enclosing an upper open end of a hollow vertical disposable container with liquid therein takes the form of a flat horizontal disc having first and second openings disposed in spaced apart positions therein. The first opening is a pin hole and the second opening is relatively large. The disc has a peripheral socket adapted to engage the periphery of the upper end of the container in such manner that liquid cannot flow out therebetween.

A hollow vertical hollow spout is employed for delivery of the liquid. said spout The spout tapers upwardly from the disc and has an open lower end coincident with the second opening. The spout has a upper end defining a first slot therein. The upper end of the spout is smaller in area than the lower end.

A hollow member disposed within the spout has an upper open end coincident with the upper end of the spout and extends downwardly and inwardly from the upper end of the spout. The member has a lower end which is horizontally aligned with the lower end of the spout. The lower end of the member contains a second slot substantially smaller in area than the first slot.

The disc, spout and member constitute a single integral unit which when positioned in place on the container will not exhibit any substantial leakage of liquid when the liquid in the container surges therein because of sudden movement of the container or when the container is disposed horizontally on its side. More particularly, only a drop or so of liquid may leak out.

The cap is formed by injection molding and displays greater structural strength than caps formed by vacuum molding. Consequently, injection molded caps can be used in applications such as soda filled containers served to children wherein vacuum molded caps can be accidently squeezed and collapse;

Since the lower end of the member is horizontally aligned with the lower end of the spout, caps in accordance with the principles of this invention cannot be stacked one above another with the spout of the lower cap extending partially within the spout of the upper cap.

BRIEF DESCRIPTION OF THE INVENTION

DETAILED DESCRIPTION OF PREFERRED EMBODIMENT

Figure 1:
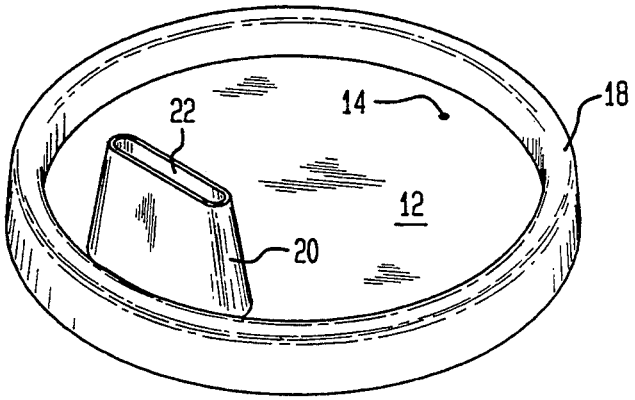
FIG. 1 is a top perspective view of a preferred embodiment of the invention.
Figure 2:
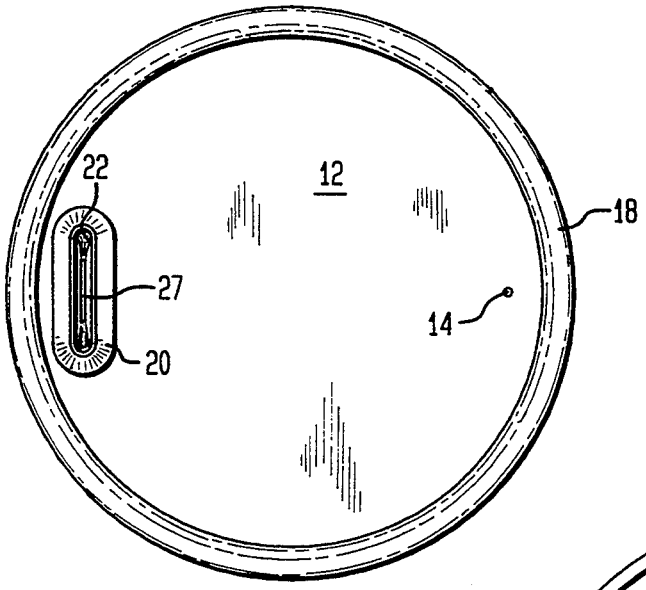
FIG. 2 is a top plan view thereof.
Figure 3:
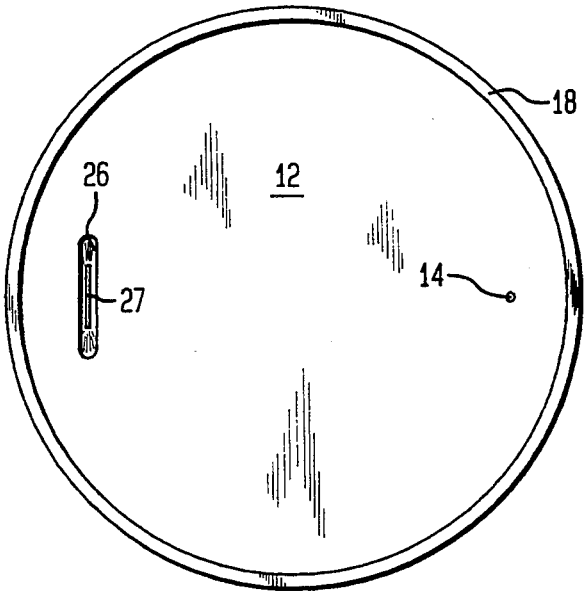
FIG. 3 is a bottom plan view thereof.
Figure 4:
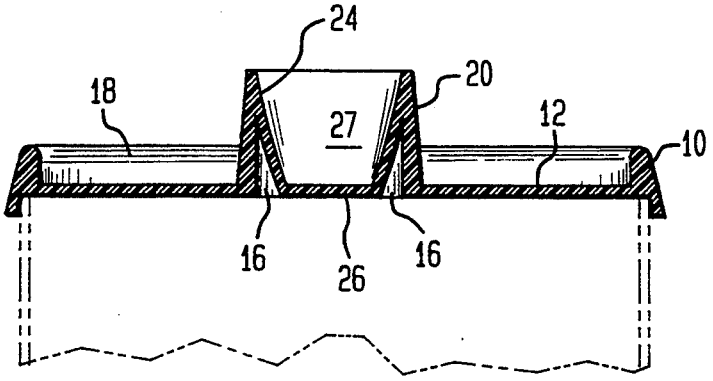
FIG. 4 is a vertical cross sectional view thereof as taken at right angles to the width of the spout.
Figure 5:
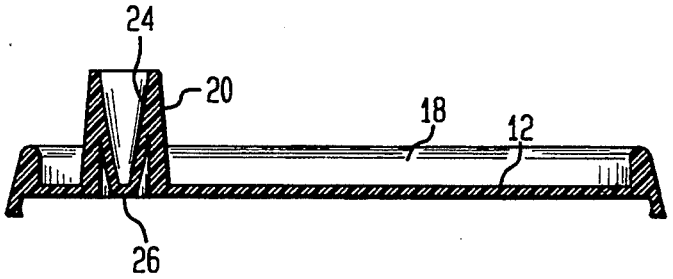
FIG. 5 is a vertical cross sectional view thereof as taken at right angles to the cross sectional view shown in FIG. 4.

Referring now to FIGS. 1–5, there is shown a cap for detach ably enclosing an upper open end 10 of a hollow vertical disposable container with liquid therein. The container has a closed lower end.

The cap employs a flat horizontal disc 12 having first and second openings 14 and 16 disposed in spaced apart positions therein. The first opening 14 is a pin hole and is used to establish a path for air to escape when the cap is positioned on a container filled with liquid as well as enabling air to enter the container as the liquid is consumed and its level is reduced. The second opening 16 is relatively large and is rectangular in shape.

The disc has a peripheral socket 18 adapted to engage the periphery of the upper end of the container so tightly that liquid cannot flow out therebetween.

A hollow vertical hollow spout 20 for delivery of the liquid tapers upwardly and outwardly from the disc. The spout has an open lower end coincident with said second opening 16. The spout has an open upper end defining a first rectangular opening or slot 22. The upper end of the spout is smaller than the lower end.

A hollow member 24 is disposed within the spout with an upper open end coincident with the upper end of the spout. The member extends downwardly and inwardly from the upper end of the spout to a lower end 26 horizontally aligned with the lower end of the spout. The lower end of the member has a second rectangular opening or slot 2 which extends in the same direction as slot 22.

The disc, spout and member constitute a single integral unit which when positioned in place on the container will not exhibit any substantial leakage of liquid when the liquid in the container surges therein because of sudden movement of the container or when the container is disposed horizontally on its side. More particularly, the leakage is limited to one or two drops of liquid.

In order to obtain this type of leakage control, the area of the second slot 26 must be appreciably smaller than the area of the first slot 22. More particularly, best results are obtained when the area of the second slot is no more than one half of the area of the first slot.

The material used in injection molding is, typically, polystyrene.

Illustrative dimensions of the preferred embodiment are as follows.

The inner diameter of the disc which extends to the inner edge of the socket is 2 and ¾ inches, while the diameter which extends to the outer edge of the socket is 3 and 118 inches.

The spout is 5/8 inches high as measured from the plane of the disc, is 13/16 inches long and ¼ inch wide as measured at its top, and is 15/16 inches long and 3/8 inches wide as measured at its bottom.

The inner side of the socket has a maximum height of 3/16 inches above the disc and the outer side of the socket is 5/16 inches in length and extends 2/16 inches below the disc. The socket is 3/16 inches thick.

The lower end of the member is horizontally aligned with the lower end of the spout. The first slot is about 3/16 inches wide and ¾ inches long. The second slot is about 1/8 inches wide and 9/16 inches long.

The spout is disposed off center in the disc and can have an outer edge coincident with the inner side of the socket if desired.

While the invention has been described with particular reference to the preferred embodiment and the drawings, the protection sought is to be limited only by the terms of the claims which follow.

What is claimed is:

1. A cap for detachably enclosing an upper open end of a hollow vertical disposable container with liquid therein, the container having a closed lower end, said cap comprising:

a flat horizontal disc having first and second openings disposed in spaced apart positions therein, the first opening being a pin hole, the second opening being relatively large, the disc having a peripheral socket adapted to engage the periphery of the upper end of the container in such manner that liquid cannot flow out therebetween a hollow vertical hollow spout for delivery of said liquid, said spout tapering upwardly and outwardly from the disc and having an open lower end coincident with said second opening, the spout having an upper open end defining a first permanently open slot therein, the upper end being smaller in area than the lower end; and a hollow member disposed within the spout with an upper open end coincident with the upper end of the spout, the member having walls which are immobile with respect to each other and which extend downwardly and inwardly from the upper end of the spout to a lower end horizontally aligned with the lower end of the spout, the lower end of the member having a second permanently open slot always smaller in area than that of the first slot;

the disc, spout and member constituting a single integral unit which when positioned in place on the container will not exhibit any substantial leakage of liquid when the liquid in the container surges therein because of sudden movement of the container or when the container is disposed horizontally on its side.

2. The cap of claim 1 wherein both the first and second slots are rectangular in shape and extend in the same direction.

3. The cap of claim 2 wherein the area of the second slot is no larger than one half the area of the first slot.

4. The cap of claim 3 wherein the single integral unit is injection molded.

5. The cap of claim 3 wherein the lower end of the member is upwardly curved.

* * * * *